United States Patent [19]

Brown

[11] Patent Number: 4,702,446

[45] Date of Patent: Oct. 27, 1987

[54] LADDER CADDY

[76] Inventor: Franklin C. Brown, 1607 Windchime Dr., Dallas, Tex. 75224

[21] Appl. No.: 39

[22] Filed: Jan. 2, 1987

[51] Int. Cl.[4] ..... E06C 7/14

[52] U.S. Cl. ..... 248/210; 248/310; 248/311.2; 248/231.9; 182/129

[58] Field of Search ..... 248/210, 311.2, 313, 248/211, 238, 309.1, 310, 312, 312.1, 316.1, 316.2, 231.9, 231.91; 182/129, 120–122

[56] References Cited

U.S. PATENT DOCUMENTS

| | | | |
|---|---|---|---|
| 2,613,010 | 10/1952 | Atkinson | 248/146 |
| 2,912,205 | 11/1959 | Toune | 248/210 |
| 2,988,768 | 6/1961 | Hill | 248/211 |
| 3,160,383 | 12/1964 | Lamm | 248/311.2 |
| 3,194,529 | 7/1965 | Brock | 248/313 |
| 3,223,369 | 12/1965 | Benninger | 248/210 |
| 3,224,720 | 12/1965 | Hain | 248/313 |
| 3,980,264 | 9/1976 | Tomasik | 248/311.2 |
| 4,441,638 | 4/1984 | Shimano | 248/311.2 |
| 4,523,733 | 6/1985 | Lunden | 248/210 |
| 4,577,820 | 3/1986 | Michaud | 248/211 |

FOREIGN PATENT DOCUMENTS

| | | | |
|---|---|---|---|
| 120754 | 11/1970 | Norway | 248/313 |

*Primary Examiner*—Reinaldo P. Machado
*Assistant Examiner*—A. Chin-Shue

[57] ABSTRACT

Ladder Caddy is a holding device for a pail of paint, and is designed for use with hollow rung extension ladders. It is so designed as to conveniently, accessibly and securely hold a pail of paint out from the side of the ladder while painting. Lader Caddy receives its basic support from a holding-arm which is inserted into one of the hollow rungs, thus eliminating the need for making tedious adjustments when attaching it to the ladder.

3 Claims, 5 Drawing Figures

LADDER CADDY

Painting from a ladder at higher levels has always had its drawbacks as related to holding the pail of paint. In practically every case the holder, or support, turns out to be a wire, bent to the shape of an "S", with one end hooked over a rung of the ladder, and the other end hooked to the wire bail of the container. At its very best the position obtained for the pail is very inconvenient as related to the painter.

The ladder caddy, on the other hand, is designed to give a pail of paint, stain, or other such substance, a simple but firm support while being used in conjunction with an extension-type hollow rung ladder. The pail *sets,* rather than *hangs,* on the ladder. The pail is also held by a narrow sheet metal band that is firmly anchored to the ladder caddy. This band is equipped with a simple wire fastener which tightens the band around the pail. The entire fixture is held to the ladder simply by inserting the tubular holding arm into a rung of the ladder. This facilitates positioning the ladder caddy to where the pail is in a convenient position at the side of the ladder. With this type of anchorage the ladder caddy also maintains a constant level. The bail is dropped to the side of the pail and is out of the way, leaving the entire opening of the pail exposed and accessible. Also, the ladder caddy can be anchored on either side of the ladder in order to accomodate the painter's likes.

Four wire tool hooks, anchored to the outside of the sheet metal holding band, provides places for several needed tools. A specially designed sheet metal retainer provides a place for the paint brush to be placed while the ladder is being moved from side to side, lengthened or shortened.

My invention provides several key advantages over other devices found in the prior art.

The main object of the present invention is to make available a fixture that will allow for a pail of paint to *set,* rather than *hang,* in an accessible and secure position to the outside of a hollow rung extension ladder while painting at higher heights, thus taking much of the usual stress out of such painting.

Another object is to design the fixture to maintain a constant level, and to remain anchored in the hollow rung when the ladder is being moved from side-to-side, lengthened or shortened.

And, finally, a further object of the present invention is to make all phases of the fixture's usage simple, functional and effective.

DETAILED DESCRIPTION OF THE DRAWINGS

Figure 1:
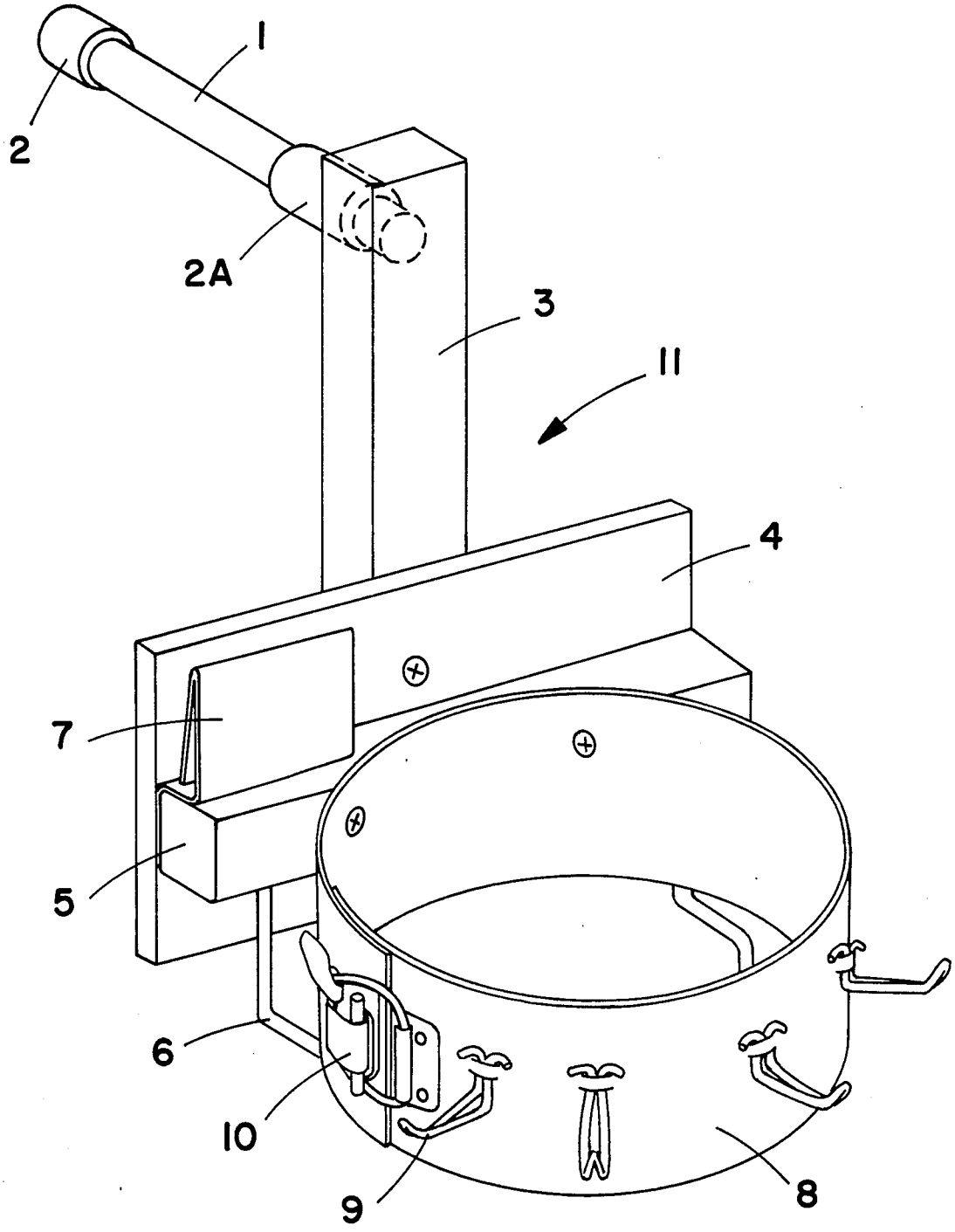
FIG. 1 is a perspective view of the ladder caddy showing the various parts.
Figure 2:
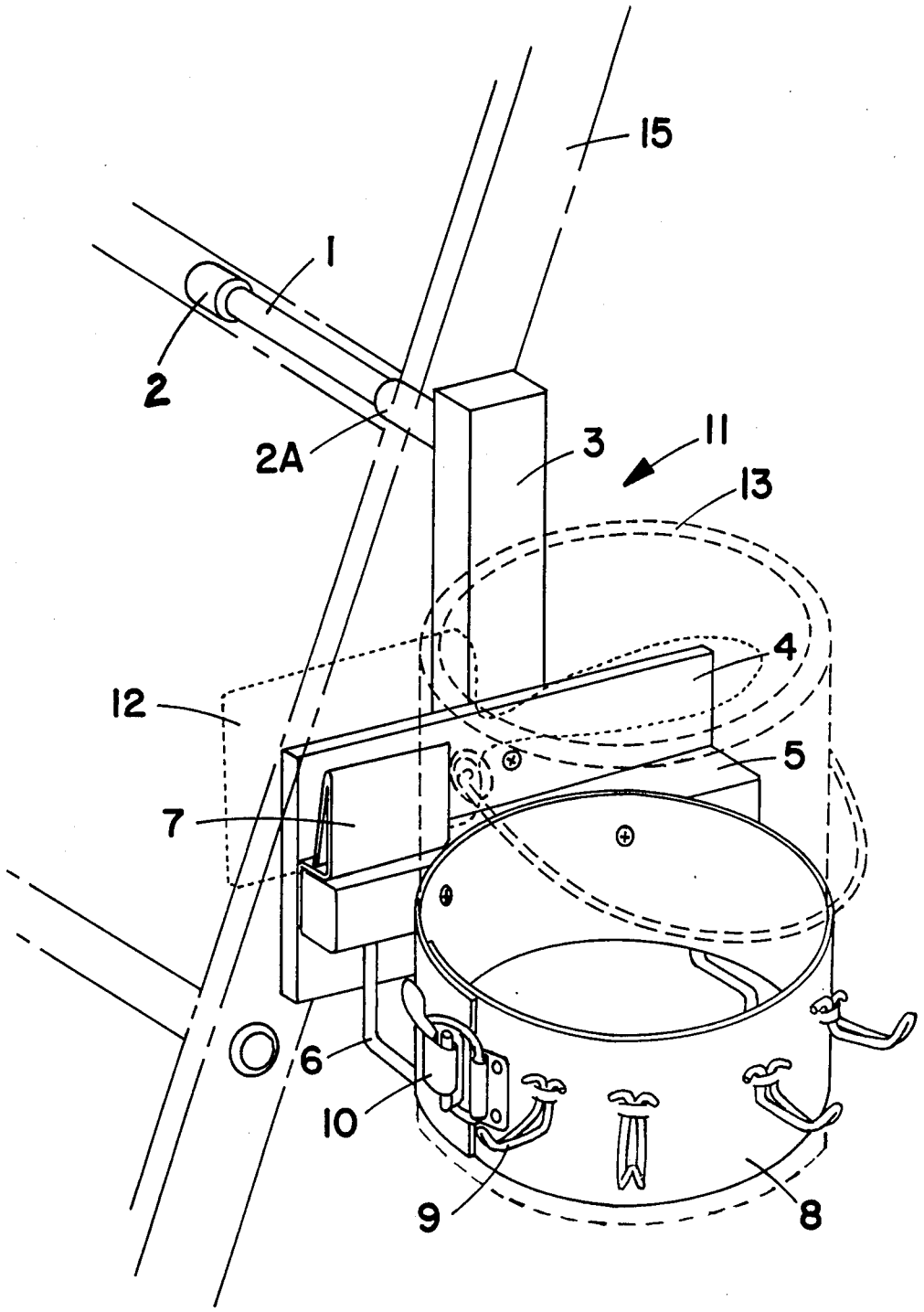
FIG. 2 is a perspective view of the ladder caddy, and shown mounted in a hollow rung of an extension ladder (portion shown with dotted lines), holding a pail and paint brush (both shown with dotted lines).

With further reference to the drawings, my ladder caddy is generally indicated in FIG. 1, and FIG. 2 (secondarily), at 11, and includes a holding-arm 1 which is made from a straight piece of ¾-inch o.d. steel tubing not less than nine inches in length anchored in a wood support-arm 3 near one end. The holding-arm is for insertion into a rung of a hollow rung extension ladder 15 (dotted), FIG. 2, and provides substantial anchorage for the ladder caddy 11. To further restrict slippage from the hollow rung, two soft rubber frictionsleeves 2 and 2A surround the holding-arm 1: one flush to the support-arm 3 and the other 2 flush to the outer end of the holding-arm 1. Sleeve 2A is slightly longer than sleeve 2.

Whereas the rungs of all hollow rung ladders are not designed the same dimensionally, the holding-arm 1 is constructed of a size that will fit closely, but freely, into hollow rungs with an inside diameter of 1 inch or larger.

Figure 4:
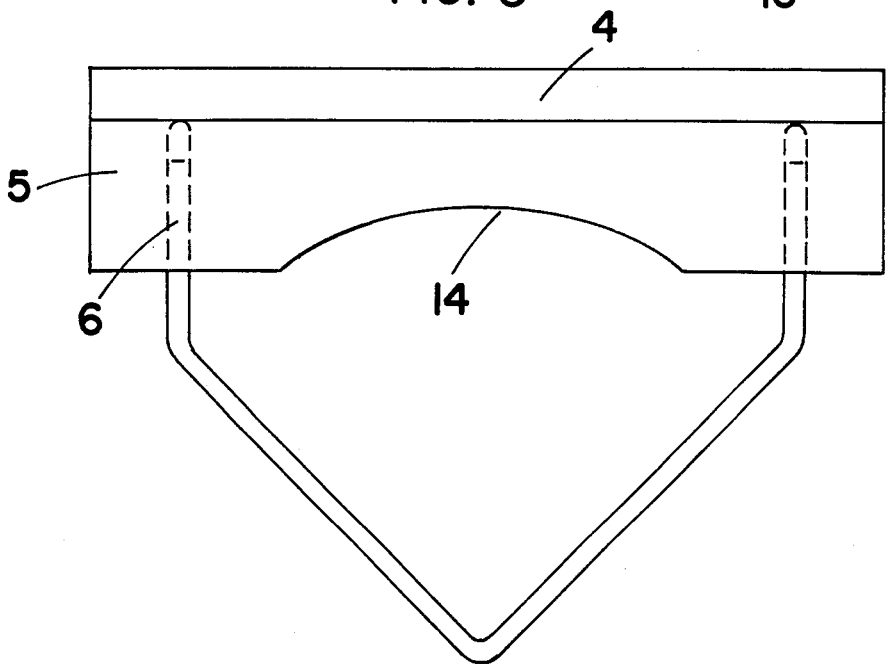
FIG. 4 is a plain view of three of the assembled parts, seen from the top, for the same purpose as FIG. 3.
Figure 5:
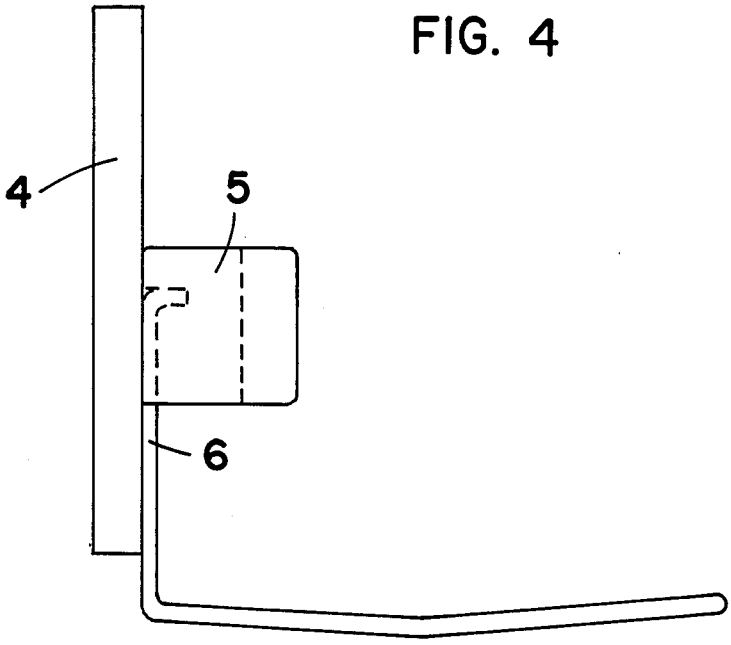
FIG. 5 is a plain view of the same parts shown in FIG. 4, but seen from the side.

Anchored to the support-arm 3 is an assembly of parts FIG. 4 and FIG. 5. Included in this assembly is a back-board 4 made of ⅜-inch, 3-ply plywood approximately 5 inches by 8 inches; a holding-band support 5 made of wood; and a pail-support rod 6. When assembled, and a part of the entire ladder caddy 11, FIG. 2 these parts provide support for the pail 13 (dotted), FIG. 2, and anchorage for the holding-band 8.

Figure 3:
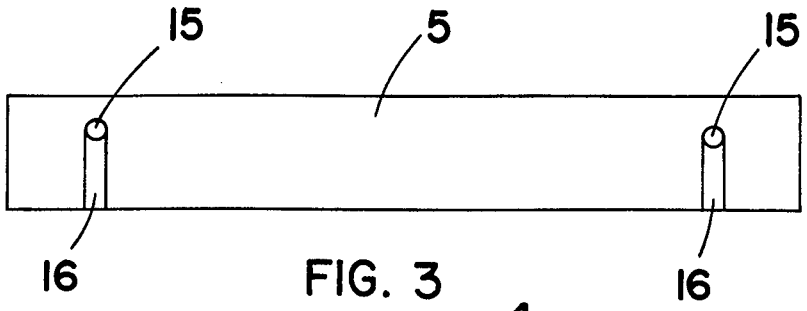
FIG. 3 is a plain view of one of the parts showing more specific detail related to design and assembly.

On what becomes the attached side of the holding-band support 5, FIG. 3, two 3/16-inch diameter holes 15, FIG. 3 are drilled to a depth of ¾-inch at a point ½-inch down from the top side, located 1 inch in from each end. From each of these two holes, downward, a groove 16, FIG. 3 is routed to contain a portion of the 3/16-inch steel rod 6 (dotted portion), FIG. 5. This allows for a flush anchor of the pail-support rod 6 (dotted portion), FIG. 5 in the holding-band support 5. The pail-support rod 6 provides a platform upon which the pail 13 (dotted), FIG. 2 rests when it is placed within the holding-band 8, FIG. 2.

Two short 90-degree bends in the pail-support rod 6 (dotted end section), FIG. 5 are designed to fit into the ¾-inch-deep holes drilled in the holding-band support 5, FIG. 3 (also see FIG. 4 and FIG. 5)and pressed firmly into place in the routed grooves 16, FIGS. 3, and 6 (dotted section), FIG. 5. This assembly is then anchored to the back-board 4, FIG. 5.

The holding-band 8, made of light weight sheet metal, is bent to an 8-inch round contour and equipped with a cam-type wire lock 10, and anchored to the holding-band support 5 in its concave section 14, FIG. 4. (Also refer to FIG. 1.

Four wire tool hooks 9 are mounted on the holding band 8, spaced to accomodate several tools, which could include a hammer, paint scraper and a putty knife.

A paint brush retainer 7 provides a secure place to put the "wiped-off" paint brush 12 (dotted), FIG. 2 while the ladder is being moved from side-to-side, lengthened or shortened. The paint brush retainer 7 is so-designed as to produce extra pressure against the paint brush 12 (dotted) FIG. 2 when it is placed on its edge in the retainer 7.

Functionally, to put the ladder caddy 11 into operation, the wire lock 10 is activated to the open position while yet on the ground. The pail is placed within the holding-band 8, FIG. 2 and comes to rest on the pail-support rod 6. The wire lock 10 is then activated to the closed position. The paint brush 12 (dotted) is placed snugly in the paint brush retainer 7. If tools are to be used they are hung on the tool hooks 9.

The ladder is positioned at the desired working point. The loaded ladder caddy 11 is carried up the ladder, either by utilizing the pail's wire bail, or by taking hold of the exposed portion of the support-arm 3. When the desired point for the work has been reached the holding-arm 1 is inserted into a hollow rung of the ladder 15 (dotted), FIG. 2 to the point where the friction sleeve 2A is in the hollow rung. The painting process can then begin. As the working position dictates, the ladder caddy 11 may be moved to another, more convenient rung.

When the readily accessible surfaces have been painted, and it is time to move the ladder from side-to-side, lengthen or shorten it, the paint brush is to be wiped on the inner edge of the pail's rim and placed in the paint brush retainer 7. The ladder caddy, with its contents, is left in position, still anchored in the hollow rung, while the movement is being affected. Painting can then be resumed.

When the work is finished, or the ladder is to be moved a considerable distance before painting can continue, the ladder caddy 11 is to be removed and carried to the ground.

What I claim is:

1. A ladder caddy for connecting, generally but not limited to, a pail of paint, stain or other such substance to a ladder having hollow rungs and utilizing the hollow portion of one of the rungs to position the pail out to the side of the ladder and comprised of: a holding arm that enters a hollow rung from either side of the ladder and equipped with two short rubber friction sleeves that surround the holding arm at each extreme end of its exposed surface; a support arm into which is anchored at its top end and at 90 degrees one end of the holding arm, and to which on its opposite side is anchored a backboard, the bottom edge of which is flush with the bottom end of the support arm; a pail holding band support which is flat on one side is anchored horizontally to, and across, the midsection of the backboard with the opposite side having a concave portion cut out to a depth of about one-half inch to match the contour of the pail; a narrow sheet metal pail holding band anchored in the concave area of the holding band support and equipped with a cam type lock for compressing the band around the pail and with tool hooks anchored to its outer side; a support rod having two parallell ends and a v-shaped horizontal base, with the parallell ends mounted between the backboard and the pail holding band support upon which horizontal portion the pail rests when placed within the pail holding band; and a sheet metal paint brush retainer, one edge of which is pressure-anchored between the backboard and holding band support and the opposite side bent in the shape of an inverted "v" thus providing additional holding pressure against the side of the brush.

2. The ladder caddy of claim 1 in which the pail holding band has in combination: a cam type lock which activates the holding band to either its extreme circumferance when relaxed to receive the pail or to its minimal circumferance when compressed around the pail;

3. The ladder caddy of claim 1 in which the two short rubber friction sleeves surround the holding arm that anchors in the hollow ladder rung: one at its outer end and the other at its anchored end, the top surface of the outer sleeve contacting the upper inner surface of the hollow rung when inserted and the lower surface of the other sleeve contacting the lower inner surface of the hollow rung to provide friction and prevent slippage of the holding arm from the rung.

* * * * *